US012653265B2

(12) United States Patent
Miles

(10) Patent No.: US 12,653,265 B2
(45) Date of Patent: Jun. 16, 2026

(54) EXPANDABLE SHOE SYSTEM

(71) Applicant: Gavin Miles, Atlanta, GA (US)

(72) Inventor: Gavin Miles, Atlanta, GA (US)

( * ) Notice: Subject to any disclaimer, the term of this patent is extended or adjusted under 35 U.S.C. 154(b) by 0 days.

(21) Appl. No.: 19/064,576

(22) Filed: Feb. 26, 2025

(65) Prior Publication Data

US 2025/0268332 A1 Aug. 28, 2025

Related U.S. Application Data

(60) Provisional application No. 63/558,210, filed on Feb. 27, 2024.

(51) Int. Cl.
*A43B 3/24* (2006.01)

(52) U.S. Cl.
CPC ..... *A43B 3/244* (2013.01)

(58) Field of Classification Search
CPC ..... A43B 13/36; A43B 3/244; A43B 3/246; A43B 3/26
USPC ..... 36/97, 15, 100
See application file for complete search history.

(56) References Cited

U.S. PATENT DOCUMENTS

| | | | | |
|---|---|---|---|---|
| 3,538,628 | A * | 11/1970 | Einstein, Jr. | A43B 3/0078 36/15 |
| 4,267,650 | A * | 5/1981 | Bauer | A43B 3/24 36/15 |
| 4,317,294 | A * | 3/1982 | Goodyear | A43B 13/36 36/36 B |
| 9,486,036 | B1 * | 11/2016 | Douglas | A43B 23/0245 |
| 12,478,131 | B1 * | 11/2025 | Frenkel | A43B 3/244 |
| 2009/0183392 | A1 * | 7/2009 | Shane | A43B 3/244 12/114.2 |

* cited by examiner

*Primary Examiner* — Ted Kavanaugh
(74) *Attorney, Agent, or Firm* — The Sladkus Law Group

(57) ABSTRACT

An adjustable modular shoe system includes interchangeable structural sole portions and an expandable expanding portion for enabling incremental resizing across both width and length vectors. Rigid sole portions in an array of sizes feature attachment points for securing locking mechanisms that couple to opposing plates arrayed along the bottom of an inherently stretchable expanding portion. Selectively positioning customized locking mechanisms having adjustable fixtures influences expansion forces applied to the coupled upper plates. This allows actively and continuously modulating expanding portion fit even after securing a given sole size. Different locking mechanism number, location, and bridging configurations transmit vectors parsed across zones needing more growth allowance compared to areas better retaining proportional shape. Incrementally tuning shoe sizing avoids one-size-fits-all industry increments dictated independent of anatomy.

13 Claims, 9 Drawing Sheets

EXPANDABLE SHOE SYSTEM

CROSS-REFERENCE TO RELATED APPLICATIONS

This application claims the benefit of and priority to U.S. Provisional Patent 63/558,210, filed Feb. 27, 2024, which is incorporated in its entirety in this document by reference.

FIELD OF DISCLOSURE

The present disclosure relates generally to footwear, and more specifically to an expandable shoe system having an expanding portion with locking mechanisms and interchangeable sole portions to achieve various expanded shoe sizes.

BACKGROUND

Traditional shoes typically come in a variety of predetermined sizes. Finding a properly fitting shoe pair often proves challenging, especially for growing children. An ideal fit provides sufficient comfort and support. Poor fit can cause slipping, rubbing, or tripping while walking. Parents face hassles and expenses of repeatedly purchasing new pairs of shoes as their children's feet rapidly grow. An expandable shoe that mechanically adjusts to safely accommodate growth would offer significant advantages.

Some adjustable sandals utilize elastics or sliding components to modify sizing. However, these styles fail to provide firm and adequate structure. The foot risks sliding around inside loose-fitting sandals. Flat sandal soles also lack adequate arch support found in properly-fitted shoes for foot development and stride.

Other expandable shoes feature midsole plug adjustments or injected air bladders to tweak inner volumes. But external shoe appearances stay fixed. Physically larger shoes present aesthetic and handling issues, potentially leading to tripping and injury risks. Youth especially prefer stylish shoes suiting their interests. Yet they can outgrow even expensive pairs of shoes within months. Finding shoe replacements gets aggravated by inconsistent sizing across brands. Time and effort getting proper measurements also pose difficulties.

Accordingly, it is desirable to provide durable and supportive shoes that can expand by full sizes. This need and other needs are met by the various aspects of the present disclosure.

SUMMARY

Presented herein are expandable shoe systems, devices and methods of expanding a shoe. The expandable shoe system can comprise an expanding portion at least partially constructed from a stretchable material and a plurality of locking mechanisms. The system can further comprise interchangeable sole portions, such that each of the plurality of sole portions comprise attachment points that can corresponding to the locking mechanisms. The attachment points can selectively mate with the locking mechanisms to securely join a sole portion to the expanding portion in an expanded size.

In various embodiments, the locking mechanisms can feature a plurality of recesses shaped to receive protruding attachment points on each of the plurality of sole portions. The protrusions can be rubber pins insertable into the recesses. Different spacing between attachment points on the various sole portions can enable different expansion states of the system. In various embodiments, each sole portion can be sized for a specific shoe size. The recesses and protrusions can snap together to firmly fix a sole portion to the expanding portion at a desired length while allowing comfortable walking.

In various embodiments, a release mechanism can enable users to detach an attached sole portion to swap in alternatives for resizing. The locking mechanisms can be positioned on the bottom of the stretchable expanding portion material to connect with attachment points on the upper surface of rigid sole portion materials. The joined components can secure the foot for a snug fit adjustable in increments by interchanging sole portions from the plurality of sole portion options.

In various embodiments, at least two of the plurality of locking mechanisms can be securedly, permanently coupled to each sole portion. The at least two locking mechanisms can be selectively attachable to the expanding portion by stretching the expanding portion as needed to engage the secured locking mechanisms.

Accordingly, in various embodiments, sole portions can accommodate the expandable expanding portion to safely accommodate growth in structured shoes. The system can maintain interior grip and exterior aesthetics through controlled incremental expanding and contracting of the overall shoe.

The system enables shoe expandability at least by coordinating swappable rigid sole portion components with a stretchable expanding portion. Each sole portion can be customized to enable a different shoe size when coupled to the common expanding portion. This can allow externally proportional shoe aesthetics avoiding a disproportionate shoe appearance. In various embodiments, using multiple sole portions can also ensure reliable support not compromised by relying only on flexible expansion materials. The system can thereby combine effective expandable shoes with desirable visual and functional attributes missing in previous offerings.

Both the foregoing brief overview and the following detailed description provide examples and are explanatory only. Accordingly, the foregoing brief overview and the following detailed description should not be considered to be restrictive. Further, features or variations can be provided in addition to those set forth herein. For example, embodiments can be directed to various feature combinations and sub-combinations described in the detailed description.

Related systems and methods of operation are also provided. Other apparatuses, methods, systems, features, and advantages of the expandable shoe will be or become apparent to one with skill in the art upon examination of the following figures and detailed description. It is intended that all such additional apparatuses, methods, systems, features, and advantages be included within this description, be within the scope of expandable shoe system, and be protected by the accompanying claims.

BRIEF DESCRIPTION OF THE DRAWINGS

The accompanying drawings, which are incorporated in and constitute a part of this disclosure, illustrate various embodiments of the present disclosure. The drawings can contain representations of various trademarks and copyrights owned by the Applicant. In addition, the drawings can contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings can contain text or captions that can explain certain embodiments of the present disclosure. This text is included for illustrative, non-limiting, explanatory purposes of certain embodiments detailed in the present disclosure. In the drawings.

DETAILED DESCRIPTION

Figure 1:
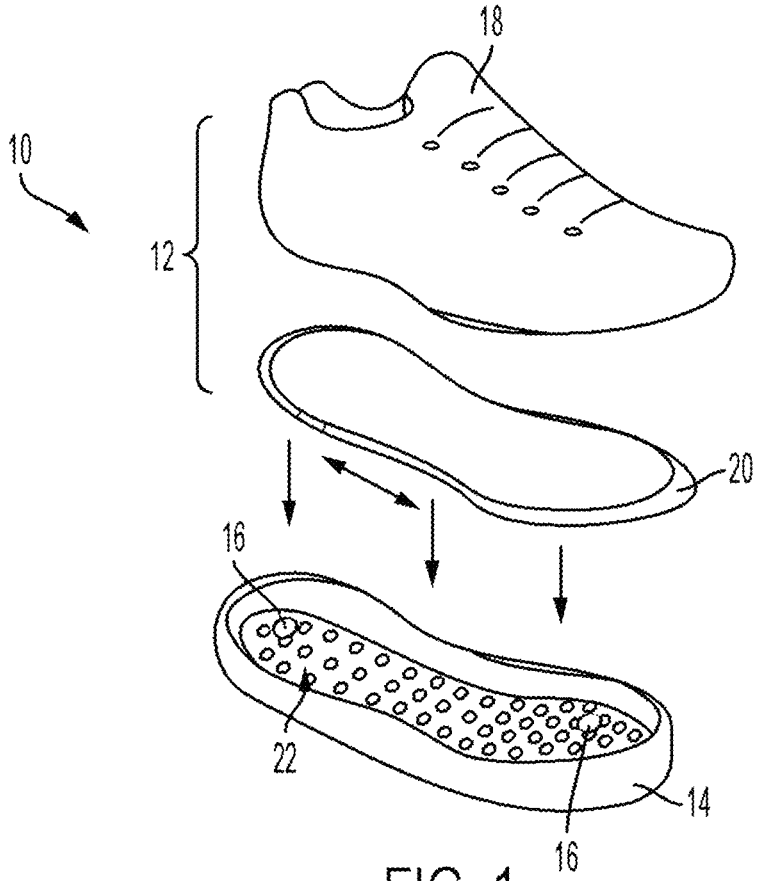
FIG. 1 is an exploded view of the expandable show system showing an expanding portion, and a sole portion, the expanding portion comprising an upper portion securedly attached to a midsole portion.
Figure 2:
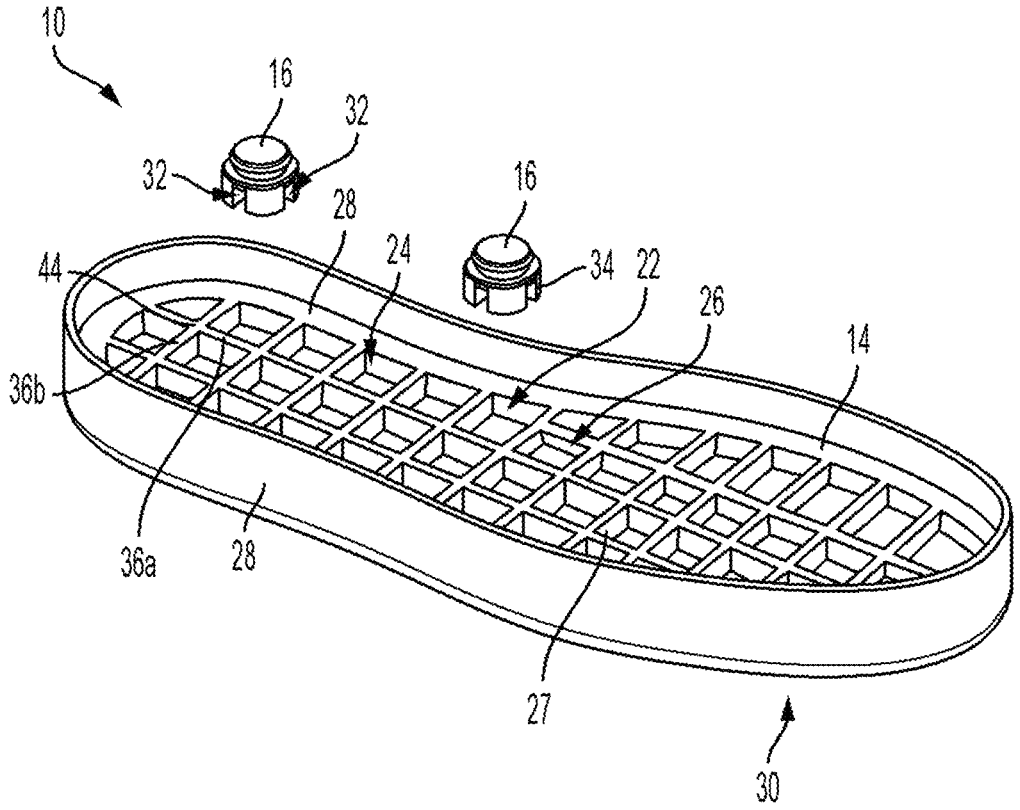
FIG. 2 illustrates an interchangeable sole portion of the expandable shoe according to one aspect, having different sizes and attachment points to accept locking mechanisms.
Figure 3:
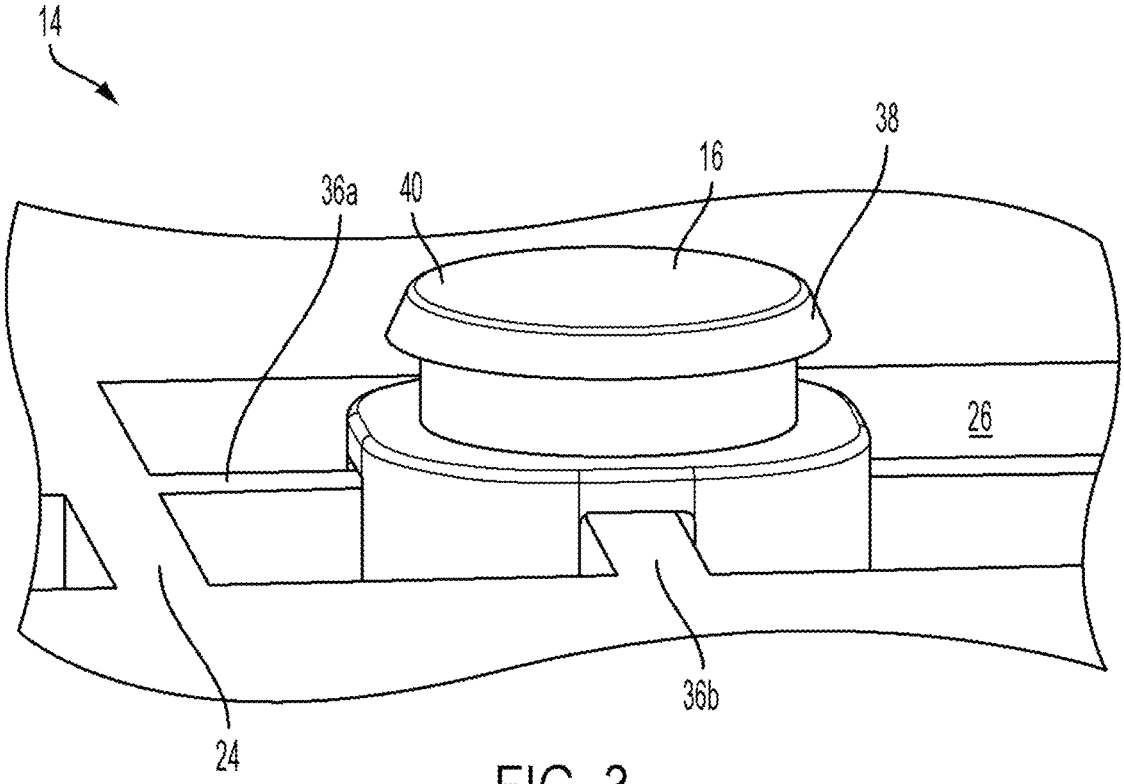
FIG. 3 illustrates a locking mechanism secured to an attachment point on an interchangeable sole portion, according to one aspect.
Figure 4:
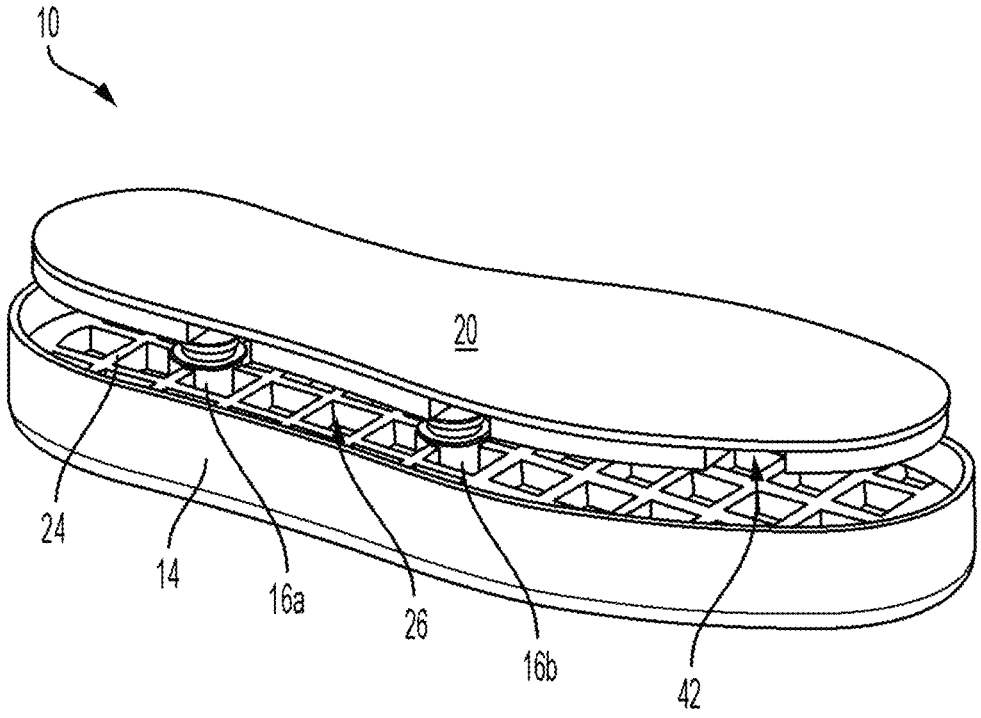
FIG. 4 illustrates joining a portion of the expanding portion to a sole portion, by interfacing the locking mechanisms with the expansion plates, according to one aspect.
Figure 5:
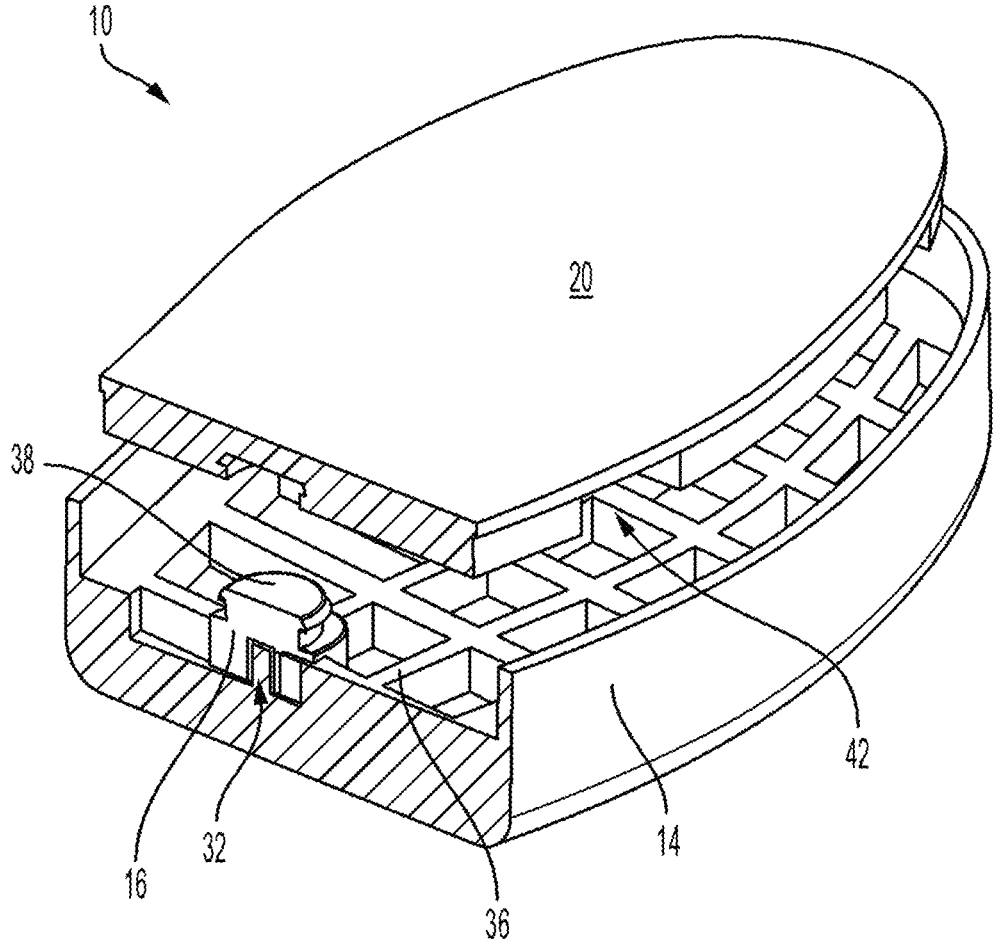
FIG. 5 is a cutaway view of a midsole portion of the expanding portion aligned with an associated locking mechanism mounted on an interchangeable sole portion, according to one aspect.
Figure 6:
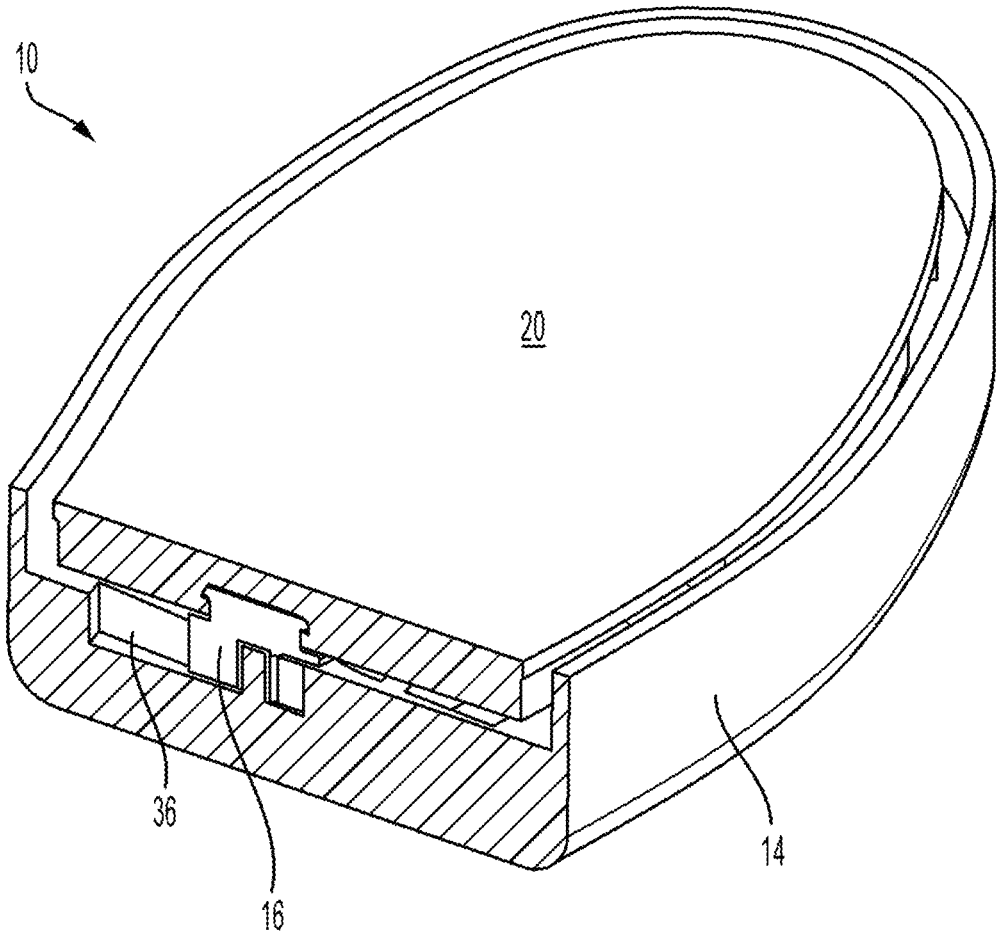
FIG. 6 is a cutaway view of the midsole portion of the expanding portion joined to a larger sized sole portion using an alternative locking mechanism positioning to achieve a different expanded size, according to one aspect.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

Any sequence(s) and/or temporal order of steps of various processes or methods that are described herein are illustrative and not restrictive. Accordingly, it should be understood that, although steps of various processes or methods can be shown and described as being in a sequence or temporal order, the steps of any such processes or methods are not limited to being carried out in any particular sequence or order, absent an indication otherwise. Indeed, the steps in such processes or methods generally can be carried out in various different sequences and orders while still falling within the scope of the present invention. Accordingly, it is intended that the scope of patent protection is to be defined by the issued claim(s) rather than the description set forth herein.

Additionally, each term used herein refers to that which an ordinary artisan would understand such term to mean based on the contextual use of such term herein. To the extent that the meaning of a term used herein, as understood by the ordinary artisan based on the contextual use of such term, differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, as used herein, "a" and "an" each generally denotes "at least one," but does not exclude a plurality unless the contextual use dictates otherwise. list. Thus, for example, reference to an "element" includes aspects having two or more such elements unless the context clearly indicates otherwise. When used herein to join a list of items, "or" denotes "at least one of the items," but does not exclude a plurality of items of the Finally, when used herein to join a list of items, "and" denotes "all of the items of the list.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint and independently of the other endpoint.

As used herein, the terms "optional" or "optionally" mean that the subsequently described event or circumstance may or may not occur, and that the description includes instances where said event or circumstance occurs and instances where it does not.

The following detailed description refers to the accompanying drawings. Wherever possible, the same reference numbers are used in the drawings and the following description to refer to the same or similar elements. While many embodiments of the disclosure can be described, modifications, adaptations, and other implementations are possible. For example, substitutions, additions, or modifications can be made to the elements illustrated in the drawings, and the methods described herein can be modified by substituting, reordering, or adding stages to the disclosed methods. Accordingly, the following detailed description does not limit the disclosure. Instead, the proper scope of the disclosure is defined by the appended claims.

Device and System Overview

This overview is provided to introduce a selection of concepts in a simplified form that are further described below. This overview is not intended to identify key features or essential features of the claimed subject matter. Nor is this overview intended to be used to limit the claimed subject matter's scope.

In various aspects, an expandable shoe system in accordance with the present disclosure can comprise an expanding portion at least partially constructed from stretchable material and a plurality of locking mechanisms. In further aspects, the system can further comprise interchangeable rigid sole portions, each comprising attachment points that correspond to the locking mechanisms. In still further aspects, the attachment points can selectively mate with the locking mechanisms to securely join a sole portion to the expanding portion in an expanded shoe size.

In further aspects, the present disclosure relates to an article of manufacture comprising: a shoe upper constructed from a stretchable material configured to expand and contract; a thin sole affixed to the shoe upper, the thin sole including a stretchable dovetail receiver; and a plurality of interchangeable outer soles, each outer sole having a variable dovetail width designed to mate with the dovetail receiver of the thin sole. The shoe upper can be adapted to stretch and conform to the size of the selected outer sole when attached.

In still further aspects, the present disclosure relates to a shoe size adjustment system, comprising: a shoe upper made of a stretchable material; a non-stretchable thin sole affixed to the shoe upper, the thin sole having a plurality of stretchable dovetail receivers; a set of interchangeable outer soles, each outer sole having a corresponding set of dovetail projections with varying widths to engage with the dovetail receivers of the thin sole; and a locking mechanism to secure the outer sole to the shoe upper. The engagement of the dovetail projections with the dovetail receivers can be configured to stretch the shoe upper to conform to the size of the outer sole. The stretchable material of the shoe upper can be a breathable knit fabric that accommodates foot expansion and contraction, and the locking mechanism can include a snap-fit feature allowing for quick and easy interchange of the outer soles. The set of interchangeable outer soles includes at least four sizes, each size incrementally larger than the previous to accommodate a range of foot growth. The dovetail projections of the outer soles include ridges that can interlock with complementary grooves on the dovetail receivers to maintain the position of the shoe upper when stretched.

In yet further aspects, the shoe upper can comprise a knit fabric designed to accommodate a range of foot sizes. The sole can include a plurality of rubber separators that align with corresponding mating features on the outer soles. The outer soles each can also include a set of circular pieces with ridges that interlock with plates on the shoe upper. The circular pieces can be designed to snap into place, thereby stretching the shoe upper to a predetermined size. In some aspects, the plurality of interchangeable outer soles can comprise at least four outer soles, each corresponding to a different shoe size within a predetermined range. In other aspects, the shoe upper and the thin sole can be integrally formed as a single piece. The attachment between the outer sole and the shoe upper can be facilitated by a locking mechanism that is manually operable. The outer soles can generally be constructed from a durable material suitable for repeated attachment and detachment from the shoe upper. The shoe upper can also include an adjustable closure mechanism to secure the shoe to the foot of a user. The variable dovetail width of the outer soles can be designed to incrementally increase in size to accommodate growth of the foot of a user. A storage mechanism for the plurality of interchangeable outer soles can be included for when not in use.

In various embodiments, the disclosed systems, devices, and articles can maintain exterior visual proportions while allowing interior size adjustments. Different spacing between attachment points on the various sole portions can enable different expansion states. Sole portions can augment the expanding portion to safely accommodate growth in structured shoes. The system can thereby combine effective expandable shoes with desirable visual and functional attributes.

Accordingly, in various embodiments, the expanding portion and sole portions coordinate to maintain interior grip and exterior aesthetics through controlled incremental expanding and contracting of the overall shoe. Users gain versatility to reversibly size the shoe for optimal comfort and support.

Embodiments of the present disclosure can comprise methods, systems, devices, articles and components comprising, but not limited to, at least one of an expanding portion and a sole portion. Details with regards to each component are provided below. Although components are disclosed with specific functionality, it should be understood that functionality can be shared between components, with some functions split between components, while other functions duplicated by the components. Furthermore, the name of the component should not be construed as limiting upon the functionality of the component. Moreover, each stage disclosed within each component can be considered independently without the context of the other stages within the same component or different components. Each stage can contain language defined in other portions of this specifications. Each stage disclosed for one component can be mixed with the operational stages of another component. In the present disclosure, each stage can be claimed on its own and/or interchangeably with other stages of other components.

The following can depict an example of a method of a plurality of methods that can be performed by at least one of the aforementioned components. Various hardware components can be used at the various stages of operations disclosed with reference to each component. For example, although methods can be described to be performed by a single apparatus, it should be understood that, in some embodiments, different operations can be performed by different apparatuses in operating in conjunction with each other.

Furthermore, although the stages of the following example method are disclosed in a particular order, it should be understood that the order is disclosed for illustrative purposes only. Stages can be combined, separated, reordered, and various intermediary stages can exist. Accordingly, it should be understood that the various stages, in various embodiments, can be performed by arrangements that differ from the ones claimed below. Moreover, various stages can be added or removed without altering or deterring from the fundamental scope of the depicted methods and systems disclosed herein.

Consistent with embodiments of the present disclosure, a method can be performed by at least one of the aforementioned components. The method can be embodied as, for example, but not limited to, instructions, which when executed, perform the method. The method can comprise one or more of the following stages: selecting a sole portion; aligning the attachment points of the selected sole portion with a plurality of locking mechanisms positioned on an expanding portion; joining the selected sole to the expanding portion; and/or engaging the locking mechanism to securely fasten the sole portion to the expanding portion.

In another embodiment, the invention can relate to a method for adjusting the size of a shoe. The method can be embodied as, for example, but not limited to, instructions, which when executed, perform the method. The method can comprise the following stages: providing a shoe upper made of a stretchable material; attaching a thin sole with a stretchable dovetail receiver to the shoe upper; selecting an outer sole with a variable dovetail width corresponding to a desired shoe size; aligning the outer sole with the shoe upper such that the dovetail receiver of the thin sole mates with the variable dovetail width of the outer sole; and/or securing the outer sole to the shoe upper, wherein the stretchable material of the shoe upper stretches to conform to the size of the outer sole.

The stretchable material of the shoe upper can comprise knit fabric or the like, and the outer sole can include circular pieces with ridges that match with plates on the upper of the shoe. The circular pieces can be snapped into place to stretch the upper. In further aspects, the method can further comprise providing a set of outer soles, each with a different variable dovetail width to accommodate a range of shoe sizes. In some aspects, the shoe upper and the thin sole with the stretchable dovetail receiver can be provided as a single integrated unit. In other aspects, the securing of the outer sole to the shoe upper can be reversible, allowing for the outer sole to be detached and replaced with another outer sole of a different size.

In various embodiments, an article of manufacture is provided. In one aspect, the article of manufacture comprises a shoe upper constructed from a stretchable material configured to expand and contract; a thin sole affixed to the shoe upper, the thin sole including a stretchable dovetail receiver; and a plurality of interchangeable outer soles, each outer sole having a variable dovetail width designed to mate with the dovetail receiver of the thin sole, wherein the shoe upper can be adapted to stretch and conform to the size of the selected outer sole when attached. In another aspect, the stretchable material of the shoe upper comprises a knit fabric designed to accommodate a range of foot sizes. The thin sole can include a plurality of rubber separators that align with corresponding mating features on the outer soles. The outer soles can each include a set of circular pieces with ridges that interlock with plates on the shoe upper. The circular pieces can be designed to snap into place, thereby stretching the shoe upper to a predetermined size. The plurality of interchangeable outer soles comprise at least four outer soles, each corresponding to a different shoe size within a predetermined range. The shoe upper and the thin sole can be integrally formed as a single piece. The attachment between the outer sole and the shoe upper can be facilitated by a locking mechanism that is manually operable. The outer soles can be constructed from a durable material suitable for repeated attachment and detachment from the shoe upper. The shoe upper can include an adjustable closure mechanism to secure the shoe to a wearer's foot. The variable dovetail width of the outer soles can be designed to incrementally increase in size to accommodate growth of a wearer's foot. The article of manufacture can further comprise a storage mechanism for the plurality of interchangeable outer soles when not in use.

In various embodiments, a shoe size adjustment system is provided. In one aspect, the shoe size adjustment system comprises a shoe upper made of a stretchable material; a non-stretchable thin sole affixed to the shoe upper, the thin sole having a plurality of stretchable dovetail receivers; a set of interchangeable outer soles, each outer sole having a corresponding set of dovetail projections with varying widths to engage with the dovetail receivers of the thin sole; and a locking mechanism to secure the outer sole to the shoe upper, wherein engagement of the dovetail projections with the dovetail receivers stretches the shoe upper to conform to the size of the outer sole. In one aspect, the stretchable material of the shoe upper can be a breathable knit fabric that accommodates foot expansion and contraction. The locking mechanism can include a snap-fit feature allowing for quick and easy interchange of the outer soles. The set of interchangeable outer soles can include at least four sizes, each size incrementally larger than the previous to accommodate a range of foot growth. The dovetail projections of the outer soles can include ridges that interlock with complementary grooves on the dovetail receivers to maintain the position of the shoe upper when stretched. The interchangeable outer soles can comprise a street shoe sole, a running shoe sole, and a trail shoe sole, each designed with a tread pattern suitable for its respective activity. The street shoe sole comprises a flat tread pattern optimized for urban environments and casual wear. The running shoe sole can include a cushioned tread design to absorb impact and provide support during running activities. The trail shoe sole can be equipped with an aggressive tread pattern for enhanced grip and stability on uneven and rugged terrain. Each of the outer soles can be color-coded to indicate its intended use, facilitating easy identification and selection by the user.

In various embodiments, a shoe size adjustment apparatus is provided. In one aspect, the shoe size adjustment apparatus comprises an upper assembly constructed from a stretchable material configured to snugly fit a range of foot sizes; a base assembly including a plurality of non-stretchable thin soles, each thin sole having a unique configuration of dovetail receivers; and a collection of interchangeable outer soles, each outer sole featuring a set of dovetail projections designed to selectively engage with the dovetail receivers of the thin soles, wherein the engagement of the dovetail projections with the receivers causes the upper assembly to adjust to the corresponding size of the outer sole. The stretchable material of the upper assembly can include a multi-directional weave to facilitate uniform stretching and contraction. The dovetail receivers can be integrally formed within the thin soles and can be arranged to provide even distribution of tension when engaged with the dovetail projections. The outer soles can be comprised of a resilient material suitable for repeated attachment and detachment without loss of structural integrity. The outer soles can include a cushioning system to enhance wearer comfort across the range of sizes. The upper assembly further comprises an adjustable strap mechanism to secure the shoe to the wearer's foot and provide additional support. The interchangeable outer soles can be coded with visual indicators corresponding to their sizes and intended use environments.

Both the foregoing overview and the following detailed description provide examples and are explanatory only. Accordingly, the foregoing overview and the following detailed description should not be considered to be restrictive. Further, features or variations can be provided in addition to those set forth herein. For example, embodiments can be directed to various feature combinations and subcombinations described in the detailed description.

System Configuration

According to various aspects of the invention, the shoes, devices, and systems of the present disclosure can comprise multiple configurations. FIGS. 1-7 illustrate non-limiting examples of embodiments of operating environments, mechanisms, and components for the disclosed devices and systems. Although the operating environments, mechanisms, and components are disclosed with specific functionality, it should be understood that functionality can be shared between mechanisms and/or components, with some functions split between mechanisms and/or components, while other functions duplicated by the mechanisms and/or components. Furthermore, the name of the mechanisms and/or components should not be construed as limiting upon the functionality of the mechanisms and/or components. Moreover, each stage in the claim language can be considered independently without the context of the other stages. Each stage can contain language defined in other portions of this specifications. Each stage disclosed for one mechanism and/or component can be mixed with the operational stages of another mechanism and/or component. Each stage can be claimed on its own and/or interchangeably with other stages of other mechanisms and/or components.

As shown in FIGS. 1-8, various embodiments of the present disclosure provide an expandable shoe system 10 comprising an expanding portion 12; a plurality of interchangeable sole portions 14, and at least one locking mechanism 16 configured to secure a sole portion 14 to the expanding portion 12.

The expanding portion 12 of the expandable shoe 10 is shown in FIG. 1, according to one aspect. The expanding portion 12 can expand to accommodate foot growth in a plurality of directions. For example, the width, length, and/or height of the expanding portion 12 can expand. In one aspect, at least a portion of the expanding portion 12 can be constructed from a textile. The textile can be any desired textile, such as, and without limitation, a multi-layer composite textile.

In various embodiments, the expanding portion 12 can be constructed to customize the stretch capacity and vectors for ergonomic shaping. The material of the expanding portion 12 can be a perforated, open-cell material. In various embodiments, contour padding can be added to provide support even at least partially at extremes of the expansion envelope. The expanding portion 12 can provide air circulation and climate regulation.

In further aspects, the expanding portion 12 can be constructed to support multidirectional stretch exceeding customary shoe material allowances. The expanding portion 12 can comprise reinforced portions to provide structural guidance. The reinforced portions can retain proportional contouring and padded comfort across incremental expansion states.

In various embodiments, the expanding portion 12 can comprise an upper portion 18 and at least one midsole plate 20. The upper portion 18 can appear to be a conventional shoe upper portion having at least one of a tongue, eyelets, laces, hook and loop fasteners and the like. In one aspect, the midsole plate 18 can be securedly attached to the upper portion 18 with for example and without limitation, adhesive, stitches, and the like. In another aspect, the midsole plate 20 can be selectively, releasably attached to the interchangeable sole portion 14. In this aspect, the locking mechanism 16 can selectively, releasably attach the midsole plate 20 to the interchangeable sole portion 14. For example, at least one sole attachment bore 42 can be defined in a lower surface 21 of the midsole plate 20. The sole attachment bore 42 can be configured to receive a portion of the locking mechanism 16 therein to couple the midsole plate 20 to the locking mechanism.

The midsole plate 20 can expand to provide a desired size of the upper portion 18. In various embodiments, the sole attachment bore 42 can comprise a plurality of sole attachment bores 42 so that engagement between the attachment bores 42 and the locking mechanism 16 can both expand the midsole plate 20 (and the upper portion 18) to a desired size and selectively, releasably attach the midsole plate 20 to the interchangeable sole portion 14 through the locking mechanism 1. In one aspect, then, the midsole plate 20 can comprise a mechanical interface between the expanding portion 12 with the locking mechanism 16 to secure the expanding portion 12 to the sole portion 14. In another aspect, the attachment bores 42 can be spaced apart at varying distances to enable different amounts of expanding portion expansion.

The interchangeable sole portion 14 can form a base for the expanding portion 12 and attachment interface for the locking mechanism 16. In various embodiments, the sole portion 14 can enable different shoe sizes. In various embodiments, the fit of the shoe can be controlled by the interface of the locking mechanisms 16 with the sole portion 14. In various embodiments, the sole portion 14 can comprise a plurality of sole portions 14, and each of the plurality of sole portions 14 can be a different size. In one aspect, any number of sole portions 14 can be provided to a user. In another aspect, each sole portion 14 can correspond to at least one conventional shoe size. For example and without limitation, a first sole portion 14 can correspond to conventional shoe size 5, a second sole portion 14 can correspond to conventional shoe size 6, a third sole portion 14 can correspond to conventional shoe size 7, a fourth sole portion 14 can correspond to conventional shoe size 8, and so on for any conventional shoe size. Further, each sole portion 14 can comprise a plurality of attachment points 22 for the locking mechanism 16.

In various embodiments, and as shown in FIGS. 2-6, the attachment points 22 can form a grid pattern 24 of recesses 26 defined in an upper surface 27 of the sole portion 14. In various embodiments, the attachment points 22 can enable the locking mechanism 16 to be positioned with a high degree of accuracy on the sole portion 14. The sole portion 14 can enable minor changes to the position of the locking mechanism 16 that can translate to a minor change in the size of the expanding portion 12. Accordingly, in various embodiments, the sole portion 14 can form the foundation for determining the size of the expanding portion 12.

In various embodiments, the sole portion 14 can provide a plurality of attachment points 22 for the locking mechanisms 16. As a non-limiting example, a reinforced perimeter 28 can surround the recessed attachment points 22 to protect mounting interfaces. The attachment points 22 distribute force from the locking mechanisms 16 across regions of the shoe 10 needing controlled expansion such as the instep, lateral midfoot, medial forefoot, and posterior heel according to biomechanical analysis of growth vectors and movement dynamics. This distribution facilitates secured acceleration and modulation of the expanding portion 12 stretch capacity via the locking mechanisms 16.

In further aspects, the interchangeable sole portions 14 can comprise an outer tread portion 30 comprising a tread pattern so that the shoe 10 can be suitable for a variety of activities. For example, the tread pattern can be designed so that the shoe 10 can be used as, including and without limitation, a street shoe, a running shoe, and a trail shoe, and the like. For example, if a street shoe is desired, the sole portion 14 can comprise a flat tread pattern optimized for urban environments and casual wear. In another example, if a running shoe is desired, the sole portion 14 can include a cushioned tread design to absorb impact and provide support during running activities. In another example, if a trail shoe is desired, the sole portion 14 can comprise an aggressive tread pattern for enhanced grip and stability on uneven and rugged terrain. In some embodiments, each of the outer tread portions 30 can be color-coded to indicate its intended use, facilitating easy identification and selection by the user.

Independent locking mechanisms 16 can act as the fastening bridge between the attachment points 22 of the sole portion 14 and the expanding portion 12. As illustrated in FIGS. 2-7, the locking mechanisms 16 can utilize a press fit to connect the sole portion 14 to the expanding portion 12. In one aspect, the locking mechanism 16 can comprise at least one slot 32 defined in a lower portion 34 of the locking mechanism 16. In this aspect, the size of the slot 32 can be selected so that at least one wall 36 of the grid pattern 24 can frictionally engage the slot 32. That is, engagement of the slot 32 of the locking mechanism 16 and the wall 36 of the sole portion 14 can securedly, detachably couple the locking mechanism 16 to the sole portion 14. In another aspect, the intersection formed between adjacent walls 36*a, b* of the sole portion can form an attachment interface 44. In this aspect, the attachment interface 44 can be configured to securedly, detachably couple the locking mechanism 16 to the sole portion 14.

A stud 38 can be formed on or attached to an upper locking portion 40 of the locking mechanism 16. In various embodiments, the stud 38 can be inserted into a sole attachment bore 42 defined in the midsole plate 20 to securedly, detachably couple the locking mechanism 16 to the expanding portion 12.

In various embodiments, the locking mechanism 16 can be positioned on the sole portion 14 corresponding to the desired size of the expanding portion 12. For example, in a first, unexpanded position, a first locking mechanism 16*a* can be positioned in a first position on the sole portion 14, and a second locking mechanism 16*b* can be positioned in a second position on the sole portion 14 that is a predetermined first distance from the first position. In a second, expanded position, the first locking mechanism 16*a* can be positioned in the first position on the sole portion 14, and the second locking mechanism 16*b* can be positioned in a third position on the sole portion 14 that is a predetermined second distance from the first position that is greater than the first distance. In order to expand the size of the expanding portion 12 then, the second locking mechanism 16*b* can moved from the second position to the third position. Alternatively, in order to reduce the size of the expanding portion 12, the second locking mechanism 16*b* can moved from the third position to the second position. It is contemplated that a plurality of locking mechanisms 16 can be used to expand the expanding portion 12 in different directions. It is also contemplated that the position of any one, two, three, four or more than four locking mechanisms 16 can be adjusted to adjust the size of the expanding portion 12 to a desired size.

The locking mechanism 16 can comprise threaded studs, clamping hardware, and adjustable fixture components mating the system layers across size-specific spatial relationships. The locking mechanism 16 can allow for rotation, sway, and angular articulation well-suited for comfort walking while attached to the sole portion. The configuration of the sole portion 14 can enable positioning of the locking mechanism 16 corresponding to specific shoe sizes. The shoe 10 formed by the expanding portion 12 and the sole portion 14 joined by the locking mechanism 16 can enable the expansion of the expanding portion 12.

Figure 7:
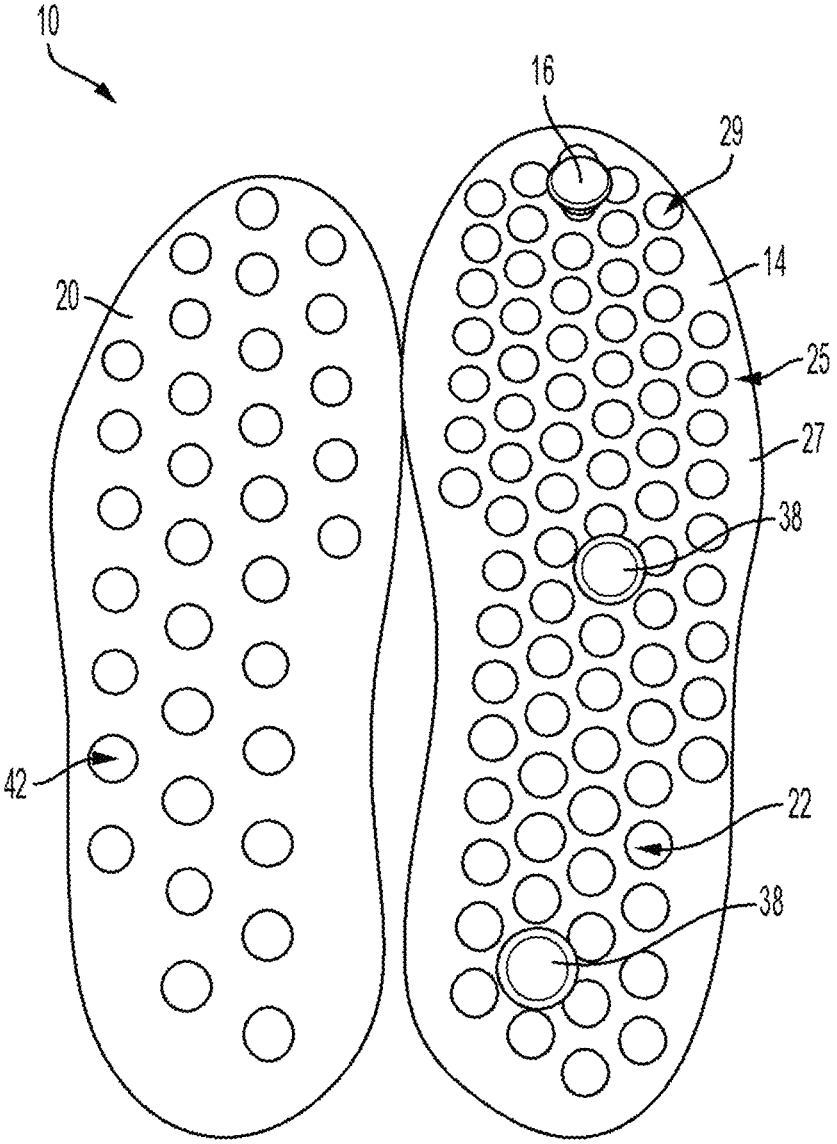
FIG. 7 is a perspective view of an interchangeable sole portion with the locking mechanism attached, according to another aspect.
Figure 8:
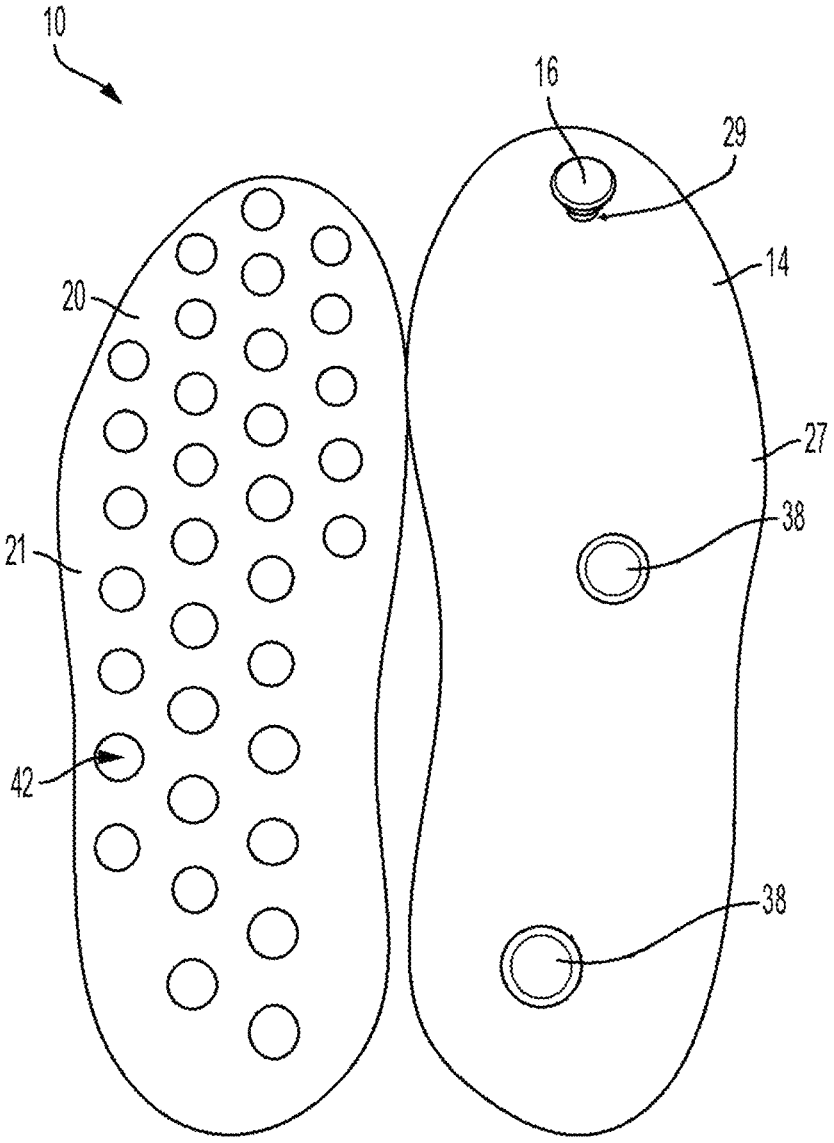
FIG. 8 is a perspective view of an interchangeable sole portion with a preset locking mechanism, according to another aspect.

Referring now to FIGS. 7 and 8, in one aspect, the plurality of attachment points 22 in the sole portion 14 can be a plurality of circular bores 29 defined in the upper surface 27 of the sole portion 14. At least two studs 38 of the locking mechanism 16 can be positioned in at least two bores 29 in predetermined locations so that the expanding portion 12 of the shoe will have a desired size. In this aspect, there can be two, three, four, five or more than five bores 29 defined in the sole portion 14. For example, if three studs 38 are to be used to size the expanding portion 12, there can be three bores 29 defined in the sole portion. In another example, there can be many bores 29 defined in the sole portion 14 (as illustrated in FIG. 7) so that studs 38 can be positioned as desired.

In one aspect, the position of the locking mechanism 16 in the sole portion 14 can be selected by the user. Alternatively, in other aspects, the position of the locking mechanism 16 in the sole portion 14 can be preset so that the user of the shoe cannot adjust the location of the locking mechanisms 16. In this aspect, the locking mechanism 16 can be securedly, non-detachably coupled with the sole portion 14 during the manufacturing process (as illustrated in FIG. 8). For example, the studs 38 in this aspect can be permanently attached to the sole portion 14 in predetermined positions so that the user cannot change the location of the locking mechanism 16 relative to the sole portion 14. In this aspect, the user can expand or retract the expanding portion 12 of the shoe so that desired sole attachment bores 42 in the midsole plate 20 align with the preset studs 38 in the sole portion 14 to securedly, detachably couple the sole portion 14 to the expanding portion 12, and so that the expanding portion 12 is a desired size.

The following depicts an example of a method of a plurality of methods that can be performed by and/or using at least one of the aforementioned components. Various hardware components can be used at the various stages of operations disclosed with reference to each component.

For example, although methods can be described to be performed by a single component, it should be understood that, in some embodiments, different operations can be performed by different components in operative relation with one another. For example, an apparatus can be employed in the performance of some or all of the stages disclosed with regard to the methods. As such, the apparatus can comprise at least one architectural component disclosed herein.

Furthermore, although the stages of the following example method are disclosed in a particular order, it should be understood that the order is disclosed for illustrative purposes only. Stages can be combined, separated, reordered, and various intermediary stages can exist. Accordingly, it should be understood that the various stages, in various embodiments, can be performed in arrangements that differ from the ones claimed below. Moreover, various stages can be added or removed from the without altering or deterring from the fundamental scope of the depicted methods and systems disclosed herein.

Figure 9:
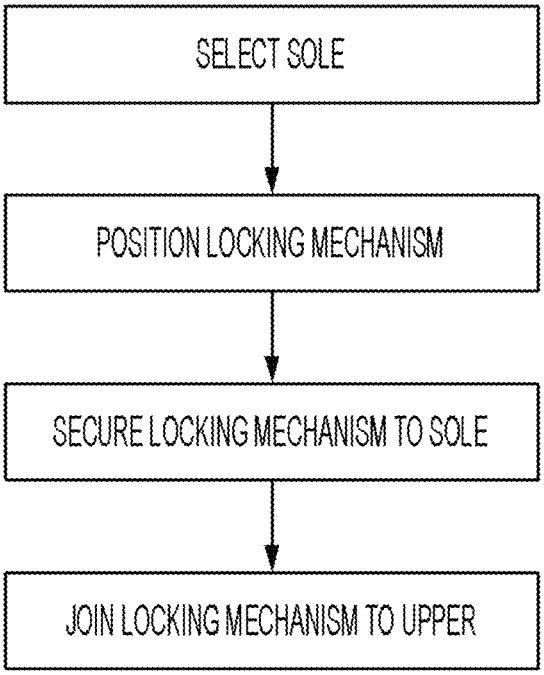
FIG. 9 is a flow chart illustrating a method of use for a disclosed expandable shoe.

Consistent with embodiments of the present disclosure, a method can be performed by at least one of the aforementioned components. In particular, FIG. 9 is a flow chart setting forth the general stages involved in a method consistent with an embodiment of the disclosure for providing and/or using the tracking device coupling mechanism.

The method can begin at starting block and proceed to stage where the user selects the sole. Users first select an interchangeable sole portion 14 with an inherent size matching the baseline shoe dimensions desired, as shown in FIGS. 2-6. For example, choosing a Size 5 sole establishes a foundation length and width fitting a typical child's feet without growth accommodation. The sole portion 14 provides structural support once the midsole plates 20 stretch the expanding portion 12 during subsequent stages. Since unexpanded sole portions 14 retain conventional shoe shaping, this selection controls retaining proper product ergonomics and aesthetics after resize. The variety of sizes of the sole portion 14 can enable users to start with an ideal baseline shoe appearance avoiding looseness or tightness before applying expansion mechanisms. Smaller feet can fill a smaller sole portion 14 surface uniformly across the span of the expanding portion 12 when relaxed. Portions too large relative to the foot risk tripping and lack of control. Users pick the closest available match to the current length and width requirements for unexpanded wear. Thereafter, the locking mechanisms 16 can be positioned on the sole portion 14.

After selecting a properly sized sole portion 14, users can determine the arrangement of locking mechanisms 16 to attach onto the sole attachment bores 42 as illustrated in FIGS. 2-6. In various embodiments, locations on the sole portion 14 map to the attachment bores 42 on the underside zones of the expanding portion 12. Users can consider current growth requirements and growth predictions to pick mounting points producing the expansion necessary. For example, distributing mechanisms across one quarter the length strains larger areas incrementally preventing discomfort from excess localized expansion. Mechanism quantity, lateral biasing, and concentration further fine tune growth patterning customized to foot changes rather than relying on symmetric uniform upper distension.

Because attachment interfaces 44 on the sole portions 14 accept locking mechanisms 16 at any combination of the intersecting walls 36*a, b*, users can selectively modify the expansion and fit of the shoe 10 personally. The repositionable, adjustable locking mechanisms 16 allow changing the size and/or shape of the expanding portion 12 to further adjust the size and/or shape of the shoe 10 for enhanced fit and/or comfort. This system flexibility empowers precise progressive or preventative expanding portion growth matching physiological development rates.

The user can secure the locking mechanisms 16 onto the attachment interface 44 of the sole portion 14 as shown in FIG. 2-6. Compatible interfaces allow twist-locking, sliding, or screwing fasteners and/or bridges onto the receiving recesses 26 arrayed across the upper surface 27 of the sole portion 14. The locking mechanisms 16 trigger no immediate expansion until engaging the expanding portion 12 in subsequent stages. Properly joined locking mechanisms 16 can allow users to preview cosmetic impacts of various layouts.

With locking mechanisms 16 secured on the attachment interface 44 of the sole portion 14 and mapped to regions needing selective size accommodation, users next join the expanding portion 12 to the locking mechanism 16. Joining the locking mechanism 16 to the expanding portion 12 can entail interfacing the locking mechanisms 16 with the expanding midsole plate 20 incorporated across the bottom of the expanding portion 12. The locking mechanism 16 protruding upwards from the sole portion 14 can physically couple to the midsole plate 20 of the expanding portion 12. The complementary mating geometry allows the locking mechanisms 16 to connect and envelope the foot overall. Locking the paired expanding portion 12 and sole portions 14 sandwiches the materials, creating closed mechanical loops transmitting vector forces when activated in the next stage.

In various embodiments, the locking mechanisms 16 secured on the attachment interface 44 of the sole portion 14 engage the expanding portion 12 to expand the shoe 10 to a larger size. This entails interfacing the locking mechanisms 16 with the midsole plate 20 of the expanding portion 12.

In another aspect, if the sole portion 14 comprises preset studs 38 as shown in FIGS. 7 and 8, a user can select a sole portion 14 with an inherent size matching the baseline shoe dimensions desired. For example, the user can be provided with a plurality of sole portions 14, wherein each sole portion 14 is a different size and corresponds to a conventional shoe size. If a user desires, for example, a size 11 shoe, the user can find the sole portion 14 of the plurality of sole portions 14 corresponding to a size 11 conventional shoe. The variety of sizes of the sole portion 14 can enable users to start with an ideal baseline shoe appearance avoiding looseness or tightness before applying expansion mechanisms.

After selecting a properly sized sole portion 14, users next join the expanding portion 12 to the sole portion 14 by mapping attachment bores 42 in the midsole plate 20 to the studs 38 extending above the sole portion 14. Joining the sole portion 14 to the expanding portion 12 can entail interfacing the locking mechanisms 16 with the expanding midsole plate 20 incorporated across the bottom of the expanding portion 12. The stud 38 protruding upwards from upper surface 27 of the sole portion 14 can securedly, couple to the midsole plate 20 of the expanding portion 12.

If the user then desires a different sole portion 14, for example to change the tread pattern from a hiking shoe to a running shoe, the user can selectively detach the expanding portion 12 from the undesired hiking sole portion 14. The user can then couple the expanding portion 12 to the desired running sole portion 14. In another example, a user could desire a different sole portion 14 because the size of the foot wearing the shoe has grown, the user can selectively detach the expanding portion 12 from the undesired smaller sole portion 14. The user can then couple the expanding portion 12 to the larger sole portion 14 to obtain a proper-fitting shoe.

The complementary mating geometry between the sole portion 14 and the midsole portion 20 allows the locking mechanisms 16 to connect and envelope the foot overall. Locking the paired expanding portion 12 and sole portions 14 sandwiches the materials, creating closed mechanical loops transmitting vector forces when activated in the next stage.

In various aspects, the components of the disclosed devices and systems can be detachably attached. In further aspects, the components can be connected by a connecting means. In still further aspects, the connecting means can comprise a fitting, insert, adhesive, screw with nut, rivet, threading, friction fit, snap-fit, twist-lock, or interlocking mechanism or a combination thereof. In yet further aspects, the connection can be achieved using a snap, friction fitting, snap ring, O-ring, pressure fitting, clip, clasp, and the like. The snap ring or O-ring can be retained within a groove to accommodate the snap ring or O-ring. In a further aspect, the system can comprise an engagement means for coupling and holding components together. In a further aspect, the engagement means can be a screwing mechanism, a click-lock mechanism, or friction mechanism, or the like. In still further aspects, the device and system components can be integrally or mechanically attached to other components. In a yet further aspect, the disclosed components can be connected, attached, or mounted using a connecting means, the connecting means comprising a fitting, insert, adhesive, screw with nut, rivet, fitting, insert, threading, friction fit, or snap-fit or a combination thereof.

In various further aspects, the device and system component characteristics and configuration, such as, for example, size and dimensions, can be configured to adjust for various foot sizes, and other factors to achieve optimal operating parameters. In further aspects, features of the device and components can be configured or utilized to set and/or control the characteristics. For example, at least one of the following can be configured: the number of the locking mechanism; the type of material used for the upper and sole portions; and the sole dimensions (e.g., height, width, thickness, surface-contacting area, etc.).

Although the stages are disclosed in a particular order, it should be understood that the order is disclosed for illustrative purposes only. Stages can be combined, separated, reordered, and various intermediary stages can exist. Accordingly, it should be understood that the various stages, in various embodiments, can be performed in arrangements that differ from the ones claimed below. Moreover, various stages can be added or removed from the without altering or deterring from the fundamental scope of the depicted methods and systems disclosed herein.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. An expandable shoe system comprising:

an expanding portion comprising an upper portion having at least one of a tongue, eyelets, laces, and hook and loop fasteners, and a midsole plate securedly, permanently coupled to the upper portion;

a plurality of sole portions, wherein at least one sole portion of the plurality of sole portions is a different size than a second sole portion of the plurality of sole portions; and a plurality of locking mechanisms, wherein at least two of the plurality of locking mechanisms are securedly, permanently coupled to each sole portion of the plurality of sole portions, wherein the plurality of locking mechanisms comprises a plurality of studs, and wherein at least two studs of the plurality of studs protrude upwards from an upper surface of a sole portion of the plurality of sole portions;

wherein each of the plurality of studs is selectively attachable to the expanding portion to securely join a sole portion of the plurality of sole portions to the expanding portion at a desired shoe size, wherein the midsole plate is selectively, releasably attachable to a sole portion of the plurality of sole portions, wherein at least one sole attachment bore is defined in a lower surface of the midsole plate, wherein the sole attachment bore is configured to receive a portion of a stud of the plurality of studs therein to couple the midsole plate to the stud, wherein the at least one sole attachment bore comprises a plurality of sole attachment bores such that engagement between at least two sole attachment bores of the plurality of sole attachment bores and the at least two of the plurality of studs expands the midsole plate and the upper portion to a desired size, wherein engagement between the at least two sole attachment bores and the at least two of the plurality of studs selectively, releasably attaches the midsole plate to a sole portion of the plurality of sole portions.

2. The expandable shoe system of claim 1, wherein at least two sole attachment bores of the plurality of sole attachment bores are mapped to the studs extending above the upper surface of the sole portion.

3. The expandable shoe system of claim 2, wherein the at least two sole attachment bores are spaced apart at varying distances to enable different amounts of expanding portion expansion.

4. The expandable shoe system of claim 3, wherein at least one sole portion of the plurality of sole portions comprises a different tread pattern than a second sole portion of the plurality of sole portions.

5. An expandable shoe system comprising:

an expanding portion comprising an upper portion and a midsole plate securedly, permanently coupled to the upper portion;

a plurality of sole portions, wherein at least one sole portion of the plurality of sole portions is a different size than a second sole portion of the plurality of sole portions, and wherein the midsole plate is selectively, releasably attachable to a sole portion of the plurality of sole portions; and a plurality of locking mechanisms, wherein at least two of the plurality of locking mechanisms are securedly, permanently coupled to each sole portion of the plurality of sole portions, wherein the plurality of locking mechanisms comprises a plurality of studs protruding upwards from an upper surface of a sole portion of the plurality of sole portions, wherein each of the plurality of studs is selectively attachable to the expanding portion to securely join a sole portion of the plurality of sole portions to the expanding portion at a desired shoe size.

6. The expandable shoe system of claim 5, wherein the upper portion comprises at least one of a tongue, eyelets, laces, and hook and loop fasteners.

7. The expandable shoe system of claim 5, wherein the midsole plate is selectively, releasably attachable to a sole portion of the plurality of sole portions.

8. The expandable shoe system of claim 5, wherein at least one sole attachment bore is defined in a lower surface of the midsole plate, and wherein the sole attachment bore is configured to receive a portion of a stud of the plurality of studs therein to couple the midsole plate to the stud.

9. The expandable shoe system of claim 8, wherein the at least one sole attachment bore comprises a plurality of sole attachment bores such that engagement between at least two sole attachment bores of the plurality of sole attachment bores and the at least two of the plurality of studs expands the midsole plate and the upper portion to a desired size.

10. The expandable shoe system of claim 9, wherein engagement between the at least two sole attachment bores and the at least two of the studs selectively, releasably attaches the midsole plate to a sole portion of the plurality of sole portions.

11. The expandable shoe system of claim 9, wherein at least two sole attachment bores of the plurality of sole attachment bores are mapped to the plurality of studs extending above the upper surface of the sole portion.

12. The expandable shoe system of claim 9, wherein the plurality of sole attachment bores are spaced apart at varying distances to enable different amounts of expanding portion expansion.

13. The expandable shoe system of claim 5, wherein at least one sole portion of the plurality of sole portions comprises a different tread pattern than a second sole portion of the plurality of sole portions.

* * * * *